US008126370B2

(12) United States Patent
Choi et al.

(10) Patent No.: US 8,126,370 B2
(45) Date of Patent: Feb. 28, 2012

(54) DEVELOPING UNIT AND IMAGE FORMING APPARATUS HAVING THE SAME

(75) Inventors: Woong Yong Choi, Yongin-si (KR); Jong Pil Jun, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 392 days.

(21) Appl. No.: 12/361,658

(22) Filed: Jan. 29, 2009

(65) Prior Publication Data

US 2009/0245877 A1 Oct. 1, 2009

(30) Foreign Application Priority Data

Mar. 28, 2008 (KR) ..... 10-2008-0029285

(51) Int. Cl.
*G03G 15/00* (2006.01)

(52) U.S. Cl. ..... 399/254; 399/119; 399/256

(58) Field of Classification Search ..... 399/254–256
See application file for complete search history.

(56) References Cited

U.S. PATENT DOCUMENTS 7,672,621 B2 * 3/2010 Sato ..... 399/258

FOREIGN PATENT DOCUMENTS

| | | |
|---|---|---|
| JP | 2002214907 | 7/2002 |
| JP | 2003140454 | 5/2003 |
| KR | 1020020007176 | 1/2002 |

OTHER PUBLICATIONS

Korean Office Action issued Feb. 18, 2011 in KR Application No. 10-2008-0029285.
Korean Office Action issued Aug. 3, 2011 in KR Application No. 10-2008-0029285.

* cited by examiner

*Primary Examiner* — Hoang Ngo
(74) *Attorney, Agent, or Firm* — Stanzione & Kim, LLP

(57) ABSTRACT

Disclosed are a developing unit, in which a developing agent storing part is closed by an agitating member, and an image forming apparatus having the same. The developing unit includes a developing agent storing part to store a developing agent, a developing part connected to the developing agent storing part, and an agitating member rotatably provided in a channel between the developing agent storing part and the developing part to transfer the developing agent stored in the developing agent storing part to the developing part, wherein the channel is closed by the agitating member.

28 Claims, 6 Drawing Sheets

DEVELOPING UNIT AND IMAGE FORMING APPARATUS HAVING THE SAME

CROSS-REFERENCE TO RELATED APPLICATIONS

This application claims priority under 35 U.S.C §119(a) from of Korean Patent Application No. 2008-0029285, filed Mar. 28, 2008, in the Korean Intellectual Property Office, the disclosure of which is incorporated herein in its entirety by reference.

BACKGROUND OF THE INVENTION

1. Field of the Invention

The present general inventive concept relates to a developing unit and an image forming apparatus having the same, and more particularly, to a developing unit, in which a developing agent storing part is closed by an agitating member, and an image forming apparatus having the developing unit.

2. Description of the Related Art

Conventional image forming apparatuses form an image onto printing media according to input signals, and include printers, copying machines, fax machines, and multi-functional machines combining their functions.

An electro-photographic image forming apparatus, which is a kind of an image forming apparatus, forms an electrostatic latent image on a surface of a photo conductor by irradiating light onto the photo conductor charged with a designated electric potential, and forms a visible image by supplying a developing agent to the electrostatic latent image. The visible image formed on the photo conductor is transferred directly to a printing medium or transferred to the printing medium through an interim transfer body, and the image transferred to the printing medium is fixed to the printing medium through an image fixing process.

Here, a developing unit supplies the developing agent to the surface of the photo conductor. The developing unit includes a developing agent storing part to store the developing agent, a developing part to adhere the developing agent to the surface of the photo conductor so as to form a visible image, and an agitating member to agitate the developing agent stored in the developing agent storing part and transfer the developing agent to the developing part simultaneously.

Such a developing unit is a consumption article having a regular life, and is detachably attached to a main body of an image forming apparatus. The developing unit may be influenced by an external force, such as impact or vibration, during a carrying process before the developing unit is installed in the image forming apparatus, and thus the developing agent stored in the developing agent storing part may leak to the outside of the developing unit or scatter. In order to solve this problem, such as the leakage or scattering of the developing agent, a shielding film was conventionally attached to an inlet of the developing agent storing part in the final stage of the manufacturing process of the developing unit.

Thus, the conventional developing unit requires a user to directly remove the shielding film before the developing unit is installed in the image forming apparatus, thus causing inconvenience to the user.

Further, the conventional developing unit increases the total manufacturing cost due to the manufacturing cost of the shielding film and also increases the manufacturing time required because of the attaching of the shielding film to the developing unit.

Moreover, since the developing agent storing unit cannot be sealed again after the shielding member is removed once, if the image forming apparatus is not used for a long time, the developing agent scatters.

SUMMARY OF THE INVENTION

The present general inventive concept provides a developing unit having an improved usability, in which it is unnecessary to remove a shielding film before the developing unit is used, and an image forming apparatus having the same.

The present general inventive concept also provides a developing unit having an improved productivity, in which a developing agent storing part is closed using an existing structure without any separate member, and an image forming apparatus having the same.

The present general inventive concept also provides a developing unit, in which a developing agent storing part is re-closed after the developing unit is installed in an image forming apparatus and begins to be used, and an image forming apparatus having the same.

The present general inventive concept also provides a developing unit of an image forming apparatus, which increases the life of a fur-type feed roller installed in the developing unit to supply a developing agent and enhances an image quality, and an image forming apparatus having the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a developing unit including a developing agent storing part to store a developing agent, a developing part connected to the developing agent storing part, and an agitating member rotatably provided in a channel between the developing agent storing part and the developing part to transfer the developing agent stored in the developing agent storing part to the developing part, wherein the channel is closed by the agitating member.

The agitating member may include a shaft, and at least one film extended in the radial direction of the shaft.

The at least one film may be prepared in plural number.

At least two films among the plural films may be attached to the shaft such that the at least two films can be extended in the opposite directions with respect to the shaft.

When the channel is closed, the front end of the at least one film may contact the inner surface of the channel.

The developing unit may further include support parts provided on the shaft to support the side ends of the at least one film.

At least one protrusion guiding the attachment position of the at least one film may be provided on the shaft.

The developing unit may include a developing roller to adhere the developing agent to a photo conductor, and a feed roller to supply the developing agent transferred from the developing agent storing part to the developing roller, and the surface of the feed roller may be cleaned by the at least one film, when the developing unit is operated.

Plate-shaped sealing members may be provided between the agitating member and the side walls of the channel.

The foregoing and/or other aspects and utilities of the present general inventive concept may also be achieved by providing a developing unit including a developing agent storing part to store a developing agent, a developing part connected to the developing agent storing part, and an agitating member rotatably provided in a channel between the developing agent storing part and the developing part to transfer the developing agent stored in the developing agent storing part to the developing part, wherein the agitating member includes a shaft and at least one elastic plate attached to the shaft, and the channel is closed by the shaft and the at least one elastic plate having a tangential direction with the shaft, which is orthogonal to the transfer direction of the developing agent.

The developing unit may include a developing roller to adhere the developing agent to a photo conductor, and a feed roller to supply the developing agent transferred from the developing agent storing part to the developing roller, and the front end of the at least one elastic plate may intermittently contact the upper and lower surfaces of the channel and the feed roller, when the agitating member rotates.

The developing unit may further include support parts provided on the shaft to support the side ends of the at least one elastic plate.

Foamed members may be respectively inserted into gaps between the agitating member and the side walls of the channel.

The foregoing and/or other aspects and utilities of the present general inventive concept may also be achieved by providing an image forming apparatus having a developing unit, the developing unit including a developing agent storing part to store a developing agent, a developing part connected to the developing agent storing part, and an agitating member rotatably provided in a channel between the developing agent storing part and the developing part to transfer the developing agent stored in the developing agent storing part to the developing part, wherein the channel is closed by the agitating member.

The agitating member may include a shaft, and at least one film extended in the radial direction of the shaft.

The at least one film may be prepared in plural number.

At least two films among the plural films may be attached to the shaft such that the at least two films can be extended in the opposite directions with respect to the shaft.

When the channel is closed, the front end of the at least one film may contact the inner surface of the channel.

The image forming apparatus may further include support parts provided on the shaft to support the side ends of the at least one film.

At least one protrusion guiding the attachment position of the at least one film may be provided on the shaft.

The developing unit may include a developing roller to adhere the developing agent to a photo conductor, and a feed roller to supply the developing agent transferred from the developing agent storing part to the developing roller, and the surface of the feed roller may be cleaned by the at least one film, when the developing unit is operated.

Plate-shaped sealing members may be provided between the agitating member and the side walls of the channel.

The foregoing and/or other aspects and utilities of the present general inventive concept may also be achieved by providing an image forming apparatus having a developing unit, the developing unit including a developing agent storing part to store a developing agent, a developing part connected to the developing agent storing part, and an agitating member rotatably provided in a channel between the developing agent storing part and the developing part to transfer the developing agent stored in the developing agent storing part to the developing part, wherein the agitating member includes a shaft and at least one elastic plate attached to the shaft, and the channel is closed by the shaft and the at least one elastic plate having a tangential direction with the shaft, which is orthogonal to the transfer direction of the developing agent.

The foregoing and/or other aspects and utilities of the present general inventive concept may also be achieved by providing an image forming apparatus including a developing agent storing part to store a developing agent, a developing part connected to the developing agent storing part, and an agitating member rotatably provided in a channel between the developing agent storing part and the developing part to transfer the developing agent stored in the developing agent storing part to the developing part, wherein the agitating member includes a shaft and at least one elastic plate attached to the shaft, and the channel is opened or closed by the at least one elastic plate according to the rotation of the agitating member, the length of the at least one elastic plate is larger than the height of the channel, and the at least one elastic plate is a completely solid type.

The foregoing and/or other aspects and utilities of the present general inventive concept may also be achieved by providing an image forming apparatus, including a developing agent storing part to store a developing agent, a developing part to transfer the developing agent onto a printing medium, and an agitating member rotatably disposed to block a channel from the developing agent storing part to the developing part in a first mode and to open the channel from the developing agent storing part to the developing part in a second mode.

The image forming apparatus may further include at least one elastic film member to prevent the developing agent from entering the developing part when the shaft is in a first position.

The developing agent may enter the developing part when the shaft is in a second position.

The image forming apparatus may further include a sensor to sense a rotation angle of the shaft.

The image forming apparatus may further include a control unit to allow a user to control a rotation of the shaft.

A developing unit usable with an image forming apparatus, including a developing agent storing part to store a developing agent, and an agitating member disposed in the developing agent storing part to transfer a first portion to a second portion thereof through a channel and to block the channel to prevent the developing agent from being transferred from the first portion to the second portion thereof.

BRIEF DESCRIPTION OF THE DRAWINGS

These and/or other aspects and utilities of the present general inventive concept will become apparent and more readily appreciated from the following description of the embodiments, taken in conjunction with the accompanying drawings in which.

DETAILED DESCRIPTION OF THE PREFERRED EMBODIMENTS

Figure 1:
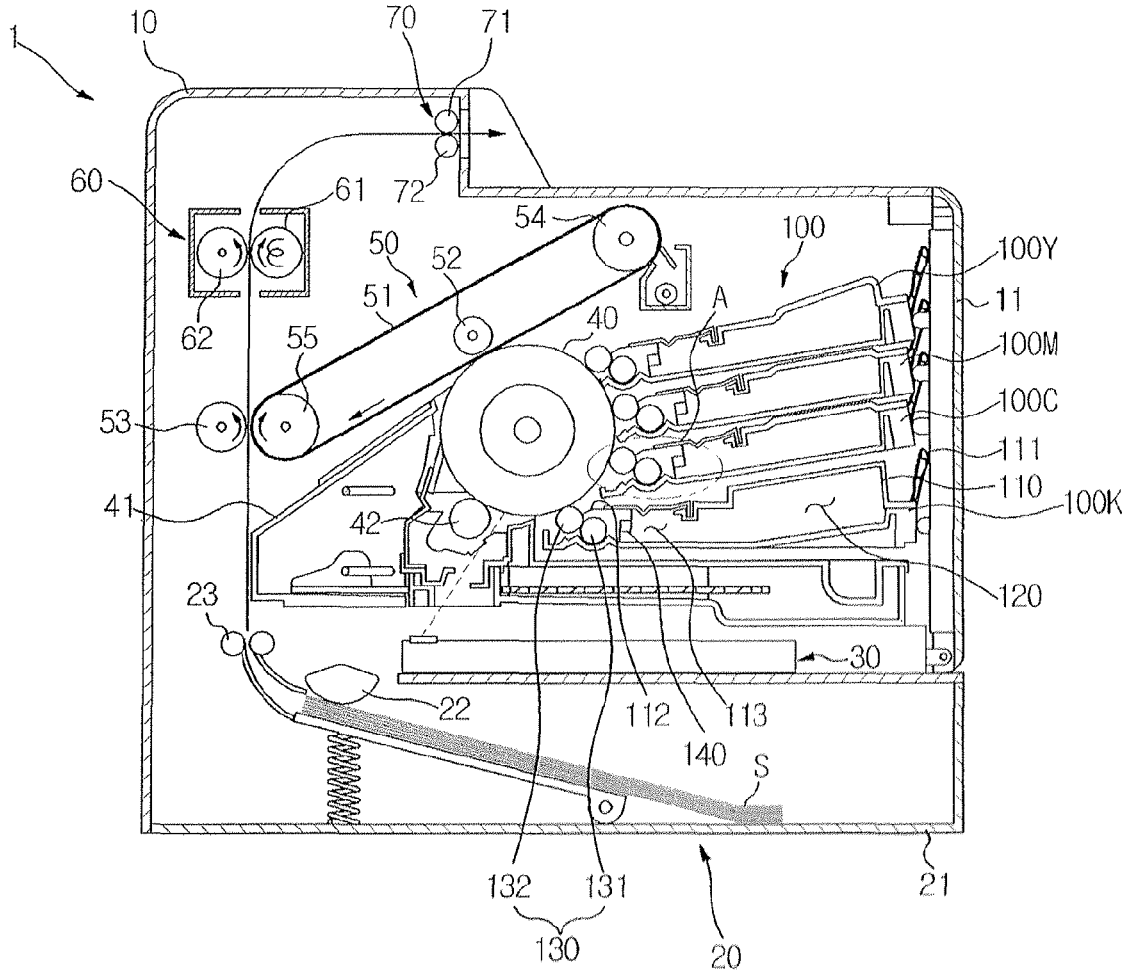
FIG. 1 is a cross-sectional view of an image forming apparatus in accordance with an embodiment of the present general inventive concept.

Reference will now be made in detail to the embodiments of the present general inventive concept, an example of which is illustrated in the accompanying drawings, wherein like reference numerals refer to like elements throughout. The embodiments are described below to explain the present general inventive concept by referring to the FIG. 1 is a cross-sectional view of an image forming apparatus in accordance with an embodiment of the present general inventive concept, and FIG. 2 is a partially exploded perspective view of a developing unit in accordance with an embodiment of the present general inventive concept.

Figure 2:
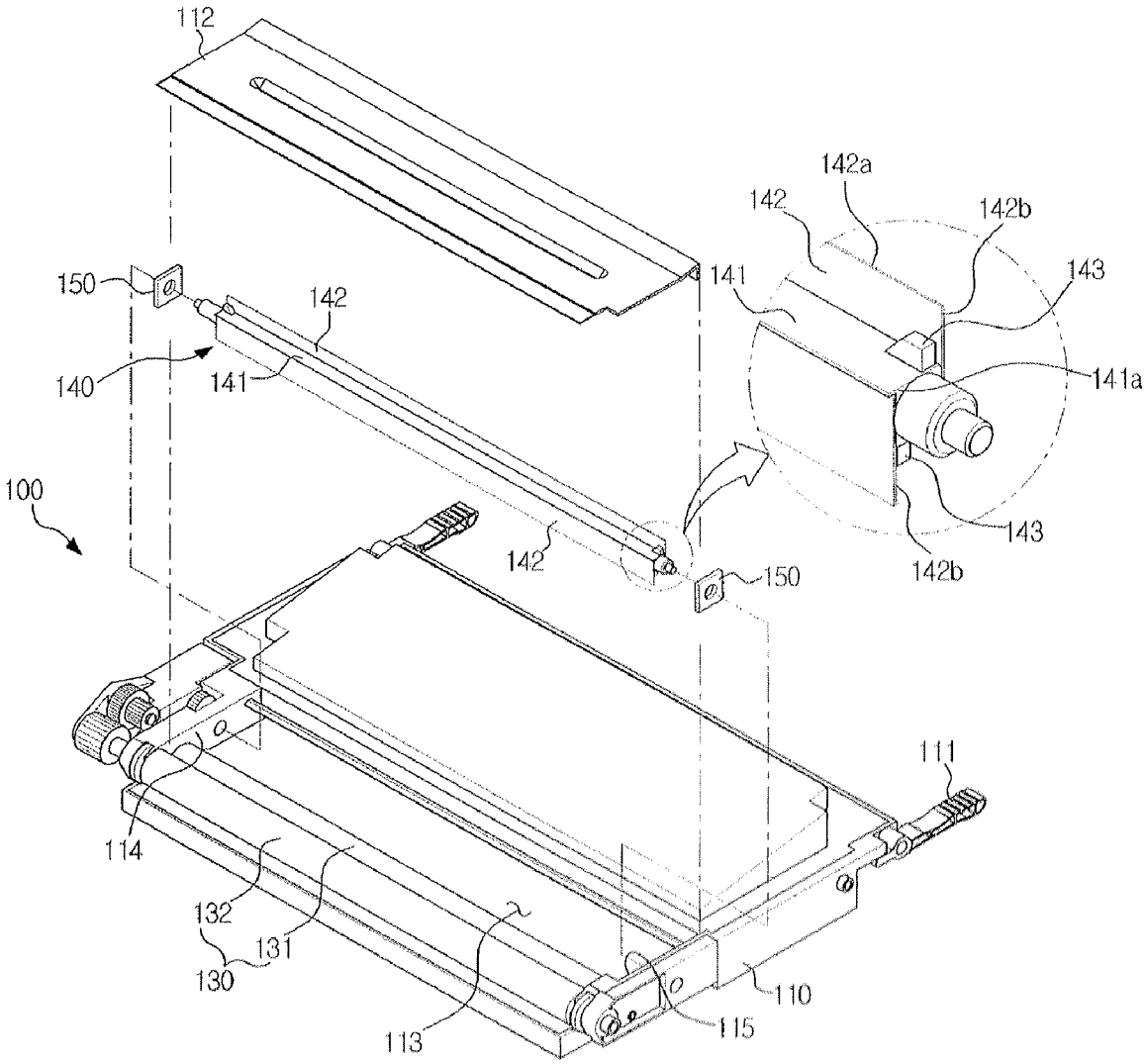
FIG. 2 is a partially exploded perspective view of a developing unit in accordance with an embodiment of the present general inventive concept.

As illustrated in FIG. 1, an image forming apparatus 1 includes a main body 10, a printing media feed device 20, a light scanning device 30, a photo conductor 40, a developing device 100, a transfer device 50, a fixing device 60, and a printing media discharge device 70.

The main body 10 forms an external appearance of the image forming apparatus 1, and supports various components installed therein. A main body cover 11 is rotatably installed at one side of the main body 10. The main body cover 11 opens and closes a portion of the main body 10. A user can access the inside of the main body 10 through the main body cover 11, and thus may attach and detach various components, including developing units 100K, 100C, 100M, and 100Y, to and from the main body 10.

The printing media feed device 20 includes a cassette 21 to store printing media (S), a pick-up roller 22 to pick up the printing media (S) stored in the cassette 21 one by one, and transfer rollers 23 to transfer the picked-up printing media (S) to the transfer device 50.

The light scanning device 30 irradiates light corresponding to image data onto the photo conductor 40, and thus forms an electrostatic latent image on the surface of the photo conductor 40.

The photo conductor 40 is rotatably installed in a photo conductor housing 41 detachably mounted in the main body 10. An electric charging roller 42 is installed in the photo conductor housing 41. The electric charging roller 42 charges the photo conductor 40 with a designated electric potential before the light scanning device 30 irradiates light onto the photo conductor 40.

The developing device 100 supplies developing agents to the photo conductor 40, on which the electrostatic latent image is formed, and thus forms a visible image. The image forming apparatus 1 of the embodiment of FIG. 1 is a color image forming apparatus. Thus, the developing device 100 includes four developing units 100K, 100C, 100M, and 100Y, which respectively contain developing agents having different colors, i.e., black, cyan, magenta, and yellow, respectively. Hereinafter, a structure of the developing unit 100K storing a black developing agent will be described. The structure of the developing unit 100K, which will be described later, may be applied to other developing units 100C, 100M, and 100Y. In FIG. 1, reference numerals 110, 120, 130, and 140 represent components of the developing unit 100K, and may be applied to components of other developing units 100C, 100M, and 100Y, respectively.

As illustrated in FIGS. 1 and 2, the developing unit 100K includes a developing unit housing 110, a developing agent storing part 120, a developing part 130, and an agitating member 140.

The developing unit housing 110 forms the external appearance of the developing unit 100K, and supports various components installed therein. Handles 111 are rotatably installed at both sides of a rear end of the developing unit housing 110 respectively, such that a user can easily hold the developing unit 100K when the developing unit 100K is attached to and detached from the image forming apparatus 1.

The developing agent storing part 120 stores the developing agent.

The developing part 130 includes a feed roller 131 and a developing roller 132. The developing part 130 receives the developing agent supplied from the developing agent storing part 120 and adheres the developing agent to the surface of the photo conductor 40, and thus forms a visible image thereon. Specifically, the developing agent stored in the developing agent storing part 120 is transferred to the feed roller 131 by the agitating member 140, which will be described later, and is supplied to the developing roller 132 by the feed roller 131. Then, the developing roller 132, to which a developing bias power supply is applied, adheres the developing agent on its surface to the surface of the photo conductor 40, on which the electrostatic latent image is formed, thus forming a visible image on the surface of the photo conductor 40. Here, a thickness of the developing agent adhered to the surface of the developing roller 132 by the feed roller 131 is regulated by a regulating member 112 provided at one side of an upper surface of the developing unit housing 110.

The agitating member 140 is rotatably provided in a transfer channel 113 connecting the developing agent storing part 120 and the developing part 130, and agitates the developing agent, stored in the developing agent storing part 120, so as not to coagulate the developing agent, and transfers the developing agent to the feed roller 131 simultaneously.

For this reason, the agitating member 140 includes a shaft 141 rotatably supported by both side walls 114 and 115 of the transfer channel 113, and films 142 attached to the shaft 141. The agitating member 140 is rotated by the driving power transmitted from a motor (not illustrated). In the embodiment of FIG. 2, the films 142 are thin film plates having a designated elastic force, which is made of a material such as polyethylene terephthalate (PET), urethane, or silicon. Further, although the embodiment of FIG. 2 illustrates two films 142 attached to the shaft 141, one film 142 may be attached to the shaft 141 such that the film 142 can be extended in the radial direction of the shaft 141, or at least three films 142 may be attached to the shaft 141 in a radial manner.

Figure 3:
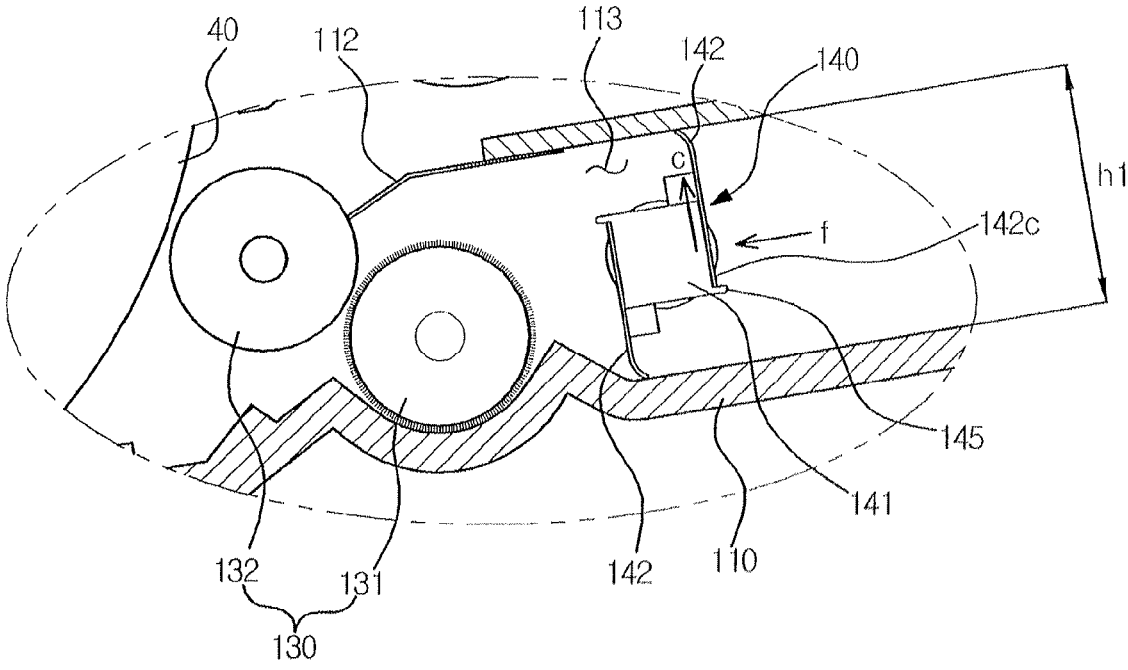
FIG. 3 is an enlarged cross-sectional view of the portion 'A' of FIG. 1, illustrating the developing unit in an unused state.
Figure 4:
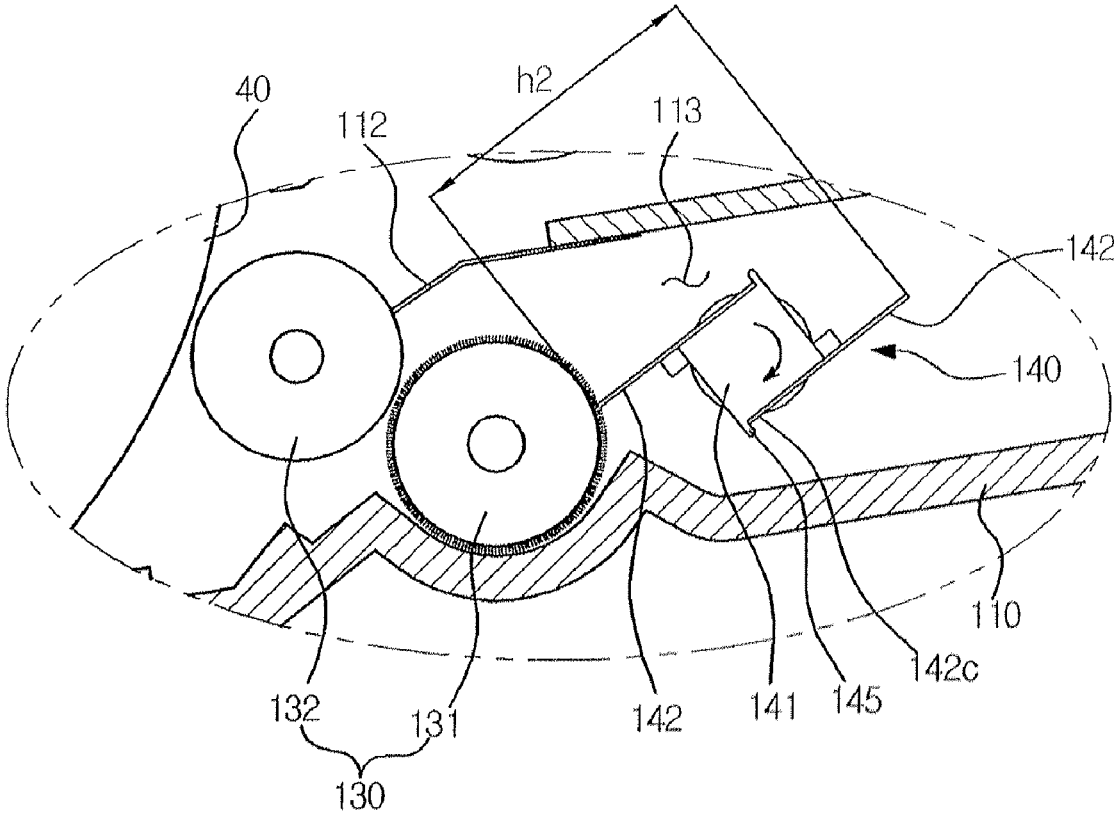
FIG. 4 is another enlarged cross-sectional view of the portion 'A' of FIG. 1, illustrating the developing unit in a used state.

FIGS. 3 and 4 are enlarged cross-sectional views of a portion 'A' of FIG. 1, and FIG. 3 illustrates the developing unit in an unused state and FIG. 4 illustrates the developing unit in a used state.

As illustrated in FIG. 3, the agitating member 140 of the present general inventive concept serves to close the transfer channel 113 to seal the developing agent storing part 120 as well as to agitate the developing agent stored in the developing agent storing part 120.

Specifically, a length of the films 142 protruding from the shaft 141 with respect to a length of the film 142 may be larger than a height of the transfer channel 113, and when a tangential direction (c) between the shaft 141 and the films 142 and the transfer direction (f) of the developing agent meet at approximately right angles to each other, front ends 142*a* of the films 142 may contact the inner surface of the transfer channel 113, and both side ends 142*b* of the films 142 and both side surfaces 141*a* of the shaft 141 are closely adhered to both side walls 114 and 115 of the transfer channel 113. Thus, the transfer channel 113 is closed such that opposite spaces inside the developing unit housing 110 may be isolated by the agitating member 140, and the developing agent is prevented from transferring from one opposite space to the other opposite space, and the developing agent storing part 120 is sealed.

The height of an upper side of the transfer channel 113 may be different from the height of a lower side of the transfer channel 113. However, the length of the film 142 is enough to block each of the heights of the upper and lower sides of the transfer channel 113.

As illustrated in FIG. 3, at least one end of the films 142 is bent when contacting the developing unit housing 110. That is, the at least one end of the films 142 is in a bending state to show a first distance (height) h1 between the both ends of the films 142 since a distance between opposite sides of the developing unit housing 100 is narrower than the first distance (height) H1. The first distance h1 becomes a second distance h2 as illustrated in FIG. 4, when one of the ends of the films 142 contacting a portion of the feed roller 131. That is, the ends of the films 142 have the second distance h2 when at least one of the ends of the films 142 does not contact the opposite sides of the developing unit housing 110.

The side of the developing unit housing 110 may have a portion to guide the ends of films 142 such that the first distance h1 is changed to the second distance h2. That is, a distance from a rotational center of the agitating member 141 to the side of the developing unit housing 110 may vary or increased according to a rotational direction of the agitating member such that the first distance h1 can be gradually changed to the second distance h2.

Figure 5:
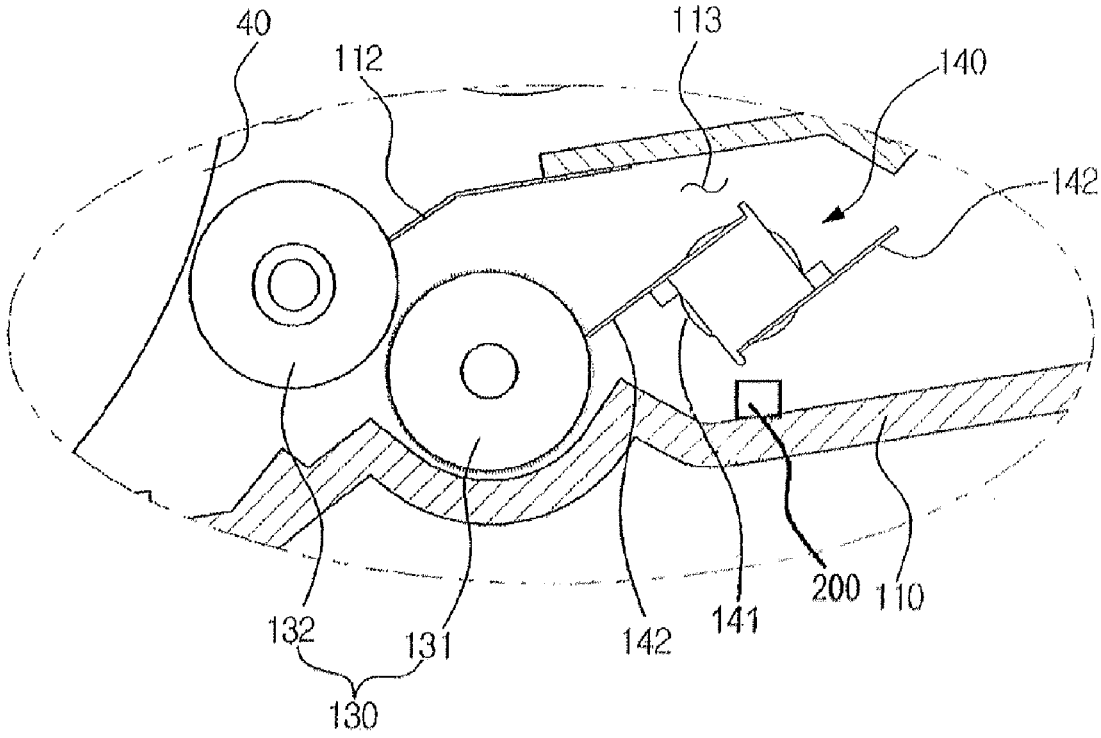
FIG. 5 is an enlarged cross-sectional view of the portion 'A' of another embodiment of the present general inventive concept, illustrating a sensor.
Figure 6:
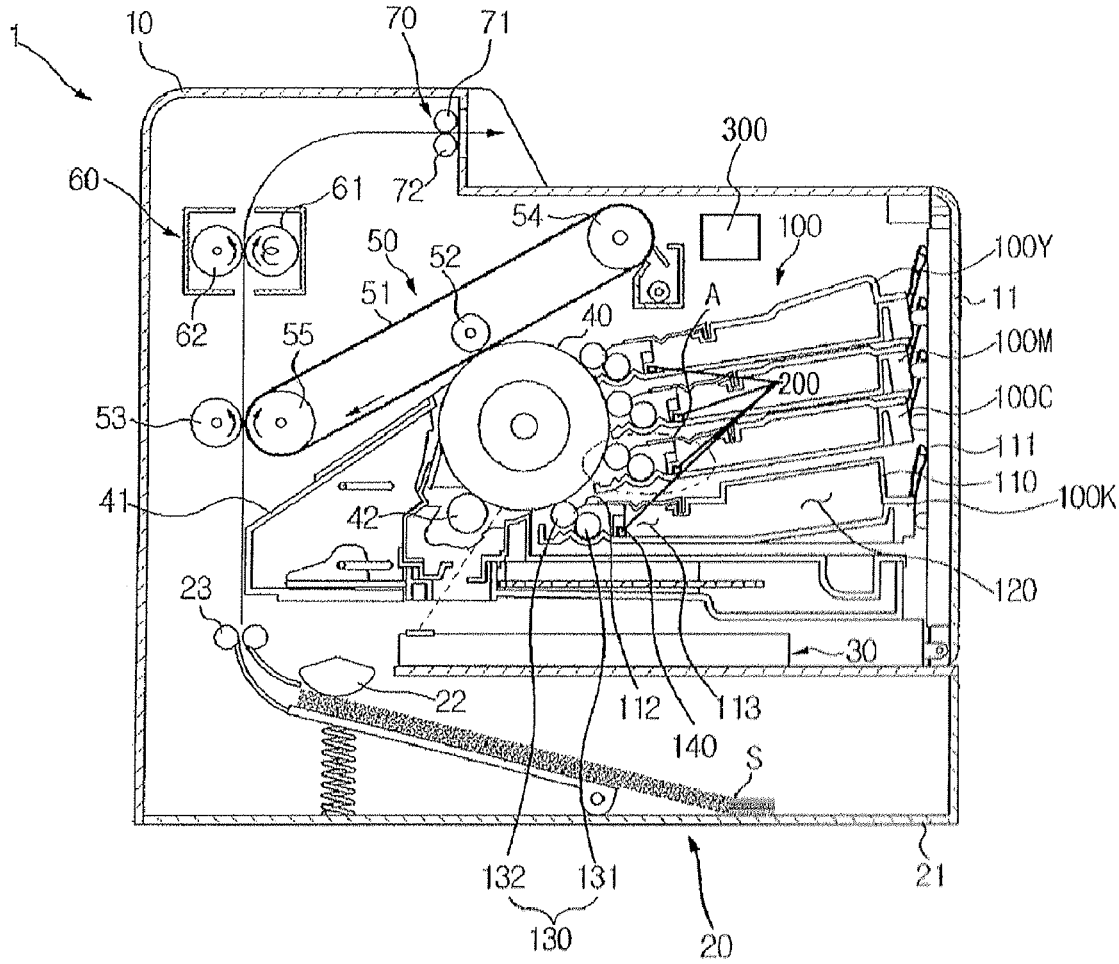
FIG. 6 is a cross-sectional view of an image forming apparatus in accordance with another embodiment of the present general inventive concept.

Accordingly, the developing unit look of the present general inventive concept can seal the developing agent storing part using the existing agitating member without adding any separate component. Further, as illustrated in FIGS. 5 and 6, the developing unit look of the present general inventive concept may further include a sensor 200 to sense the rotating angle of the agitating member and a control unit 300 to control the rotating angle of the agitating member, such that when the developing unit 100K is not used for a long time or a user inputs instructions to close the developing agent storing part 120, the developing agent storing part 120 can be automatically sealed. Of course, in the case that the developing unit 100K does not have a separate sensor 200 or control unit 300, the user can manually rotate the shaft 141 of the agitating member when it is expected that the developing unit will not be used for a long time, and thus seal the developing agent storing part.

As illustrated in FIG. 2, the developing unit 100K of the present general inventive concept further includes plate-shaped sealing members 150, which are inserted between both side walls 114 and 115 of the transfer channel 113 and the agitating member 140 so as to increase airtight force. The sealing members 150 may be made of a soft material having a high restoring force so as to minimize the interference with the films 142 when the agitating member 140 is rotated and to obtain a sufficient airtight force when the agitating member 140 is stopped. For example, the sealing members 150 may be made of a sponge-type soft material including polyurethane, poron, or ethylene propylene diene monomer (EPDM), or a rubber-type soft material including epoxy, urethane, or silicon.

The developing unit 100K of the present general inventive concept further includes support parts 143 respectively provided at both sides of the shaft 141. The support parts 143 prevent both side ends 142*b* of the films 142 from being excessively folded in a direction opposite to the rotating direction of the shaft 141 due to the friction with both side walls 114 and 115 of the transfer channel 113 or the sealing members 150, and vary an elastic force of central portions of the films 142 and the elastic force of the portions of the films 142, at which the support parts 143 are installed. Particularly, as the elastic force of the portions of the films 142, at which the support parts 143 are installed, increases, the developing agent feeding force at both sides of the films 142 is strengthened, thereby overcoming a difficulty in supplying the developing agent to both sides of the agitating member 140.

Further, as illustrated in FIG. 3, one protrusion or a plurality of protrusions may be installed on the shaft 141. The protrusion serves as a reference plane to attach the film 142 to the shaft 141. Further, as the developing agent flows into distal ends of the films 142 according to the rotation of the agitating member 140, the protrusions serve to prevent the films 142 from being separated from the shaft 141.

As illustrated in FIG. 4, as the agitating member 140 rotates, the front ends 142*a* of the films 142 of the agitating member 140 intermittently contact the feed roller 131 as well as intermittently contact upper and lower surfaces of the transfer channel 113. Thereby, the surface of the feed roller 131 is struck by or rubbed with the films 142, thus being cleaned.

Generally, a sponge-type or fur-type cylindrical roller is used as the feed roller 131. In the embodiment of FIG. 4, the fur-type feed roller 131 is used, and effectively removes a portion of the developing agent, which is not supplied from the feed roller 131 to the developing roller 132 and is coagulated or caught between fur.

In the embodiment of FIG. 4, the shaft 141 has an approximately rectangular cross-section, and the two films 142 are attached to the shaft 141 such that the two films 142 are respectively extended in the opposite directions with respect to the shaft 141. Of course, the cross section of the shaft 141 may have various shapes, and the number of the films 142 attached to the surface of the shaft 141 is not limited. However, the films 142 may be installed symmetrically, and may be attached to the shaft 141 such that tangential directions of the films 142 with the shaft 141 are parallel with each other and are respectively extended in the opposite directions with respect to the shaft 141.

Further, in order to effectively block of the flow of the developing agent in the sealed state of the developing agent storing part 120, a plate-shaped thin film, which is a completely solid type without holes or spaces formed therein, may be used as the films 142.

Although this embodiment defines the transfer channel 113 divided from the developing agent storing part 120 and the developing part 130, it may be appreciated that the developing part 130 includes the transfer channel 113.

As illustrated in FIG. 1, the transfer device 50 includes an interim transfer belt 51, a first transfer roller 52, and a second transfer roller 53.

The interim transfer belt 51 is supported by support rollers 54 and 55, and travels at the similar velocity to the linear velocity of the photo conductor 40.

The first transfer roller 52 is opposite to the photo conductor 40 under the condition that the interim transfer belt 51 is interposed between the first transfer roller 52 and the photo conductor 40, and causes the visible image formed on the photo conductor 40 to be transferred to the interim transfer belt 51.

The second transfer roller 53 is opposite to the support roller 55 when the interim transfer belt 51 is interposed between the second transfer roller 53 and the support roller 55. The second transfer roller 53 is separated from the interim transfer belt 51 while the image is transferred from the photo conductor 40 to the interim transfer belt 51, and contacts the interim transfer belt 51 with a predetermined pressure when the image on the photo conductor 40 is completely transferred to the interim transfer belt 51. When the second transfer roller 53 contacts the interim transfer belt 51, the image on the interim transfer belt 51 is transferred to a printing medium.

The fixing device 60 includes a heating roller 61 having a heat source, and a pressing roller 62 installed opposite to the heating roller 61. When the printing medium passes through a gap between the heating roller 61 and the pressing roller 62, the image is fixed to the printing medium by heat transmitted from the heating roller 61 and pressure applied between the heating roller 61 and the pressing roller 62.

The printing media discharge device 70 includes an exit roller 71 and an exit backup roller 72, and discharges the printing medium passed through the fixing device 60 to the outside of the main body 10.

Hereinafter, the operation of the above image forming apparatus 1 will be described in brief.

When a printing operation is started, the surface of the photo conductor 40 is uniformly charged by the electric charging roller 42. The light scanning device 30 irradiates light of any one color, for example, light corresponding to yellow image data, onto the surface of the photo conductor 40, and thus an electrostatic latent image corresponding to a yellow image is formed on the photo conductor 40.

The agitating member 140 of the yellow developing unit 100Y rotates, and thus agitates the developing agent stored in the developing agent storing part 120 and transfers the developing agent to the feed roller 131 of the developing part 130 simultaneously. Then, the transferred developing agent is supplied to the developing roller 132 by the feed roller 131. Accordingly, the front ends 142*a* of the films 142 of the agitating member 140 strike or rub against the surface of the feed roller 131, and thus sweep away off the developing agent, which is not adhered to the photo conductor 40 and remains on the surface of the feed roller 131.

Thereafter, a developing bias power supply is applied to the developing roller 132. Thereby, a yellow developing agent is adhered to the electrostatic latent image, and forms a yellow visible image. This visible image is transferred to the interim transfer belt 51 by the first transfer roller 52.

When the transfer of the yellow color of the amount of one page has been completed, the light scanning device 30 irradiates light of another color, for example, light corresponding to magenta image data, onto the surface of the photo conductor 40, and thus an electrostatic latent image corresponding to a magenta image is formed on the photo conductor 40. The magenta developing unit 100M supplies a magenta developing agent to the electrostatic latent image, and forms a magenta visible image. The magenta visible image formed on the photo conductor 40 is transferred to the interim transfer belt 51 by the first transfer roller 52. Here, the magenta visible image is overlapped with the yellow visible image, which was transferred in advance from the developing unit 100Y.

When the cyan developing unit 100C and the black developing unit 100K perform the above-described process, a color image, obtained by overlapping the yellow, magenta, cyan, and black images, is completed on the interim transfer belt 51. The completed color image is transferred to the printing medium passing through a gap between the interim transfer belt 51 and the second transfer roller 53, and the printing medium passes through the fixing device 60 and is discharged to the outside of the main body 10 via the printing media discharge device 70.

When the printing operation is completed or stopped, the agitating members 140 of the respective developing units 100K, 100C, 100M, and 100Y return to the state illustrated in FIG. 3 in order to close the transfer channel 113. This operation may be automatically carried out by the sensor 200 to sense the rotating angle of the agitating member 140 and the control unit 300 to control the rotating angle of the agitating member 140, or may be manually carried out by a user.

As apparent from the above description, the present general inventive concept provides a developing unit, in which a developing agent storing part is closed by an agitating member without any separate member, so as to improve a productivity of the developing unit as well as allowing the developing unit to have a simple and compact structure, and an image forming apparatus having the same. Of course, the developing unit eliminates an inconvenience of removing a shielding member therefrom before the developing unit is used.

Further, in the developing unit of the present general inventive concept, the developing agent storing part can be reclosed even after the developing unit begins to be used.

Although embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A developing unit, comprising:

a developing unit housing having a developing part including a developing roller and a feed roller, and a developing agent storing part to store a developing agent, the developing unit housing having a flat configuration with a channel formed therein between the developing agent storing part and the developing part, the channel defined by a top wall and a bottom wall; and an agitating member rotatably provided in the channel between the developing agent storing part and the developing part to transfer the developing agent stored in the developing agent storing part to the developing part, the agitating member including a shaft and a first film and a second film attached to the shaft, wherein when the agitating member is in a first rotational position, the agitating member closes the channel by the first film contacting an inner surface of the top wall defining the channel and the second film contacting an inner surface of the bottom wall defining the channel to prevent the developing agent stored in the developing agent storing part from moving to the developing part.

2. The developing unit according to claim 1, wherein the first film and the second film are extended in the radial direction of the shaft.

3. The developing unit according to claim 1, where the first film and the second film are attached to the shaft such that the first film and the second film can be extended in the opposite directions with respect to the shaft.

4. The developing unit according to claim 2, further comprising support parts provided on the shaft to support the side ends of at least one film of the first film and the second film.

5. The developing unit according to claim 2, wherein at least one protrusion guiding the attachment position of at least one film of the first film and the second film is provided on the shaft.

6. The developing unit according to claim 2, wherein:

the developing unit includes the developing roller to adhere the developing agent to a photo conductor, and the feed roller to supply the developing agent transferred from the developing agent storing part to the developing roller; and the surface of the feed roller is cleaned by at least one film of the first film and the second film, when the developing unit is operated.

7. The developing unit according to claim 1, wherein plate-shaped sealing members are provided between the agitating member and the side walls of the channel.

8. The developing unit according to claim 1, wherein the agitating member includes at least one elastic plate attached to the shaft, and the channel is closed by the shaft and the at least one elastic plate having a tangential direction with the shaft, which is orthogonal to the transfer direction of the developing agent.

9. The developing unit according to claim 8, wherein:

the developing unit includes the developing roller to adhere the developing agent to a photo conductor, and the feed roller to supply the developing agent transferred from the developing agent storing part to the developing roller; and the front end of the at least one elastic plate intermittently contacts the upper and lower surfaces of the channel and the feed roller, when the agitating member rotates.

10. The developing unit according to claim 8, further comprising:

support parts provided on the shaft to support the side ends of the at least one elastic plate.

11. The developing unit according to claim 8, wherein foamed members are respectively inserted into gaps between the agitating member and the side walls of the channel.

12. An image forming apparatus having a developing unit, the developing unit comprising:

a developing unit housing having a developing part including a developing roller and a feed roller, and a developing agent storing part to store a developing agent, the developing unit housing having a flat configuration with a channel formed therein between the developing agent storing part and the developing part, the channel defined by a top wall and a bottom wall; and an agitating member rotatably provided in the channel between the developing agent storing part and the developing part to transfer the developing agent stored in the developing agent storing part to the developing part, the agitating member including a shaft and a first film and a second film attached to the shaft, wherein when the agitating member is in a first rotational position, the agitating member closes the channel by the first film contacting an inner surface of the top wall defining the channel and the second film contacting an inner surface of the bottom wall defining the channel to prevent the developing agent stored in the developing agent storing part from moving to the developing part.

13. The image forming apparatus according to claim 12, wherein the first film and the second film are extended in the radial direction of the shaft.

14. The image forming apparatus according to claim 12, where the first film and the second film are attached to the shaft such that the first film and the second film can be extended in the opposite directions with respect to the shaft.

15. The image forming apparatus according to claim 13, further comprising support parts provided on the shaft to support the side ends of the first film and the second film.

16. The image forming apparatus according to claim 13, wherein at least one protrusion guiding the attachment position of at least one film of the first film and the second film is provided on the shaft.

17. The image forming apparatus according to claim 13, wherein:

the developing unit includes the developing roller to adhere the developing agent to a photo conductor, and the feed roller to supply the developing agent transferred from the developing agent storing part to the developing roller; and the surface of the feed roller is cleaned by at least one film of the first film and the second film, when the developing unit is operated.

18. The image forming apparatus according to claim 12, wherein plate-shaped sealing members are provided between the agitating member and the side walls of the channel.

19. The image forming apparatus according to claim 13, wherein the agitating member includes at least one elastic plate attached to the shaft, and the channel is closed by the shaft and the at least one elastic plate having a tangential direction with the shaft, which is orthogonal to the transfer direction of the developing agent.

20. The image forming apparatus according to claim 13, wherein:

the agitating member includes at least one elastic plate attached to the shaft, and the channel is opened or closed by the at least one elastic plate according to the rotation of the agitating member;

the length of the at least one elastic plate is larger than the height of the channel; and the at least one elastic plate is a completely solid type.

21. An image forming apparatus, comprising:

a developing unit housing having a developing part including a developing roller and a feed roller, and a developing agent storing part to store a developing agent, the developing unit housing having a flat configuration with a channel formed therein between the developing agent storing part and the developing part, the channel defined by a top wall and a bottom wall; and an agitating member rotatably disposed to block the channel from the developing agent storing part to the developing part in a first mode and to open the channel and transfer the developing agent from the developing agent storing part to the developing part in a second mode, the agitating member including a shaft and a first film and a second film attached to the shaft, wherein when the agitating member is in the first mode, the agitating member closes the channel by the first film contacting an inner surface of the top wall defining the channel and the second film contacting an inner surface of the bottom wall defining the channel to prevent the developing agent stored in the developing agent storing part from moving to the developing part.

22. The image forming apparatus of claim 21, further comprising:

a sensor to sense a rotation angle of the shaft.

23. The image forming apparatus of claim 21, further comprising:

a control unit to allow a user to control a rotation of the shaft.

24. A developing unit usable with an image forming apparatus, comprising:

a developing unit housing having a developing part including a developing roller and a feed roller, and a developing agent storing part to store a developing agent, the developing unit housing having a flat configuration with a channel formed therein between the developing agent storing part and the developing part, the channel defined by a top wall and a bottom wall; and an agitating member including a shaft and a first film and a second film attached to the shaft and disposed in the developing agent storing part to transfer the developing agent from a first portion to a second portion of the developing agent storing part through a channel and to block the channel to prevent the developing agent from being transferred from the first portion to the second portion of the developing agent storing part, wherein when the agitating member is in a first rotational position, the agitating member closes the channel by the first film contacting an inner surface of the top wall defining the channel and the second film contacting an inner surface of the bottom wall defining the channel to prevent the developing agent stored in the developing agent storing part from moving to the developing part.

25. The developing unit of claim 1, wherein a longitudinal edge potion of the first film bends when contacting inner surfaces of the developing unit housing and a longitudinal edge portion of the second film bends when contacting inner surfaces of the developing unit housing, and the agitating member is rotatable to a second rotational position to open the channel enabling the developing agent stored in the developing agent storing part to move to the developing part.

26. A developing unit comprising:

a developing roller;

a feed roller;

a developing unit housing to support the developing roller and the feed roller, the developing unit housing including a developing agent storing part to store a developing agent and a channel formed between the developing agent storing part and the feed roller, the channel defined by a top wall and a bottom wall; and an agitating member rotatably provided in the channel of the developing unit housing between the developing agent storing part and the feed roller, the agitating member including a shaft and a first film and a second film attached to the shaft, wherein, when the agitating member is in a first rotational position, the first film contacts the top wall defining the channel and the second film contacts the bottom wall defining the channel so as to prohibit the developing agent stored in the developing agent storing part from moving to the feed roller.

27. The developing unit of claim 26, wherein the developing unit housing has a flat configuration with the channel formed between the developing agent storing part and the feed roller.

28. The developing unit of claim 26, wherein a longitudinal edge portion of the first film bends when contacting inner surfaces of the developing unit housing and a longitudinal edge portion of the second film bends when contacting inner surfaces of the developing unit housing, and the agitating member is rotatable to a second rotational position to open the channel enabling the developing agent stored in the developing agent storing part to move to the feed roller.

* * * * *